US006733694B2

(12) United States Patent
Morikawa et al.

(10) Patent No.: US 6,733,694 B2
(45) Date of Patent: May 11, 2004

(54) ELECTRIC RESISTANCE MATERIAL

(75) Inventors: Hiroshi Morikawa, Shin-Nanyo (JP); Katsunori Babazono, Shin-Nanyo (JP); Takahiro Fujii, Shin-Nanyo (JP); Takashi Yamauchi, Shin-Nanyo (JP)

(73) Assignee: Nisshin Steel Co., Ltd., Tokyo (JP)

( * ) Notice: Subject to any disclaimer, the term of this patent is extended or adjusted under 35 U.S.C. 154(b) by 140 days.

(21) Appl. No.: 10/108,039

(22) Filed: Mar. 27, 2002

(65) Prior Publication Data

US 2003/0062511 A1 Apr. 3, 2003

(30) Foreign Application Priority Data

Aug. 1, 2001 (JP) ..... 2001-233277

(51) Int. Cl.[7] ..... H01B 1/02; C22C 38/40; C22C 38/58

(52) U.S. Cl. ..... 252/512; 420/34; 148/310; 148/327

(58) Field of Search ..... 252/512, 521.2; 420/34, 43, 56; 148/325, 310, 327

(56) References Cited

U.S. PATENT DOCUMENTS 3,723,102 A * 3/1973 Lowe ..... 420/34
6,379,477 B1 * 4/2002 Ono ..... 148/327
6,599,376 B2 * 7/2003 Morikawa et al. ..... 148/306

FOREIGN PATENT DOCUMENTS

EP 1281784 * 5/2003

* cited by examiner

*Primary Examiner*—Mark Kopec
(74) *Attorney, Agent, or Firm*—Webb Ziesenheim Logsdon Orkin & Hanson, P.C.

(57) ABSTRACT

An electric resistance material comprises an Fe—Cr—Ni alloy having composition of C up to 0.1%, Si up to 5%, Mn up to 6%, 9–32% Cr, 6–25% Ni, N up to 0.2%, 0–3% Mo, 0–4% Cu, 0–5% Al, 0–0.4% Ti, 0–0.4% Nb, 0–0.005% B and the balance being substantially Fe with the previsions that the value A defined by the formula (1) and the value B defined by the formula (2) are not less than 78 and not less than 14, respectively. The electric resistance material is high of resistivity with less temperature dependency, and a resistor made therefrom works well without noises during flow of electricity.

$$A = 0.008\times(\%\ Cr)^3 - 0.43\times(\%\ Cr)^2 + 8.03\times(\%\ Cr) + 6.8\times(\%\ Si) + 10.9\times(\%\ Al) + 0.56\times(\%\ Mo) + 0.92\times(\%\ Ni) \quad (1)$$

$$B = (\%\ Ni) + (\%\ Cu) + 0.6\times(\%\ Mn) + 9.69\times(\%\ C + \%\ N) + 0.18\times(\%\ Cr) - 0.11\times(\%\ Si)^2 \quad (2)$$

2 Claims, 1 Drawing Sheet

ELECTRIC RESISTANCE MATERIAL

BACKGROUND OF THE INVENTION

The present invention relates to electric resistance material for use as a resistor represented by an earth resistor installed in a main transformer or a power generator at a neutral point, a main or brake resistor for a resistance-controlled vehicle, etc.

A resistor shall have the characteristic that its resistivity is not affected by change of the environment but kept at a constant value. However, the resistor is often heated with Joule heat. For instance, a power or vehicle resistor is heated up to 400° C. or so due to heavy electric current. Since a metal resistor has the disadvantage that its resistivity increases as elevation of a temperature in general, such high electric resistance material with less temperature dependency of resistivity has been used so far for a power or vehicle resistor.

An Fe—Cr—Al alloy, e.g. FCH1 or FCH2, is already known as high electric resistance material. Since FCH1 or FCH2 contains 17–26 mass % of Cr and 2–6 mass % of Al, its resistivity is high with less temperature dependency. However, FCH1 or FCH2 is ferromagnetic, so that a magnetic field is generated by electric current through a resistor. The magnetic field causes vibration of the resistor and occurrence of noise. The vibration and noise can be inhibited by use of non-magnetic material, e.g. NCH1, NCH2 or NCH3, as a resistor. However, NCH1, NCH2 and NCH3 are expensive due to inclusion of Ni at a high ratio and also inferior of hot-workability due to deformation resistance at an elevated temperature as well as occurrence of surface defect (sleaver defect) during hot-rolling.

By the way, stainless steel such as SUS304, which contains 18 mass % or so of Cr, has resistivity of 70 $\mu\Omega\cdot$cm higher than common steel, but the resistivity is greatly varied in response to temperature change compared with conventional electric resistance material. Furthermore, stainless steel SUS304, which is non-magnetic in annealed state, is changed to ferromagnetic state by mechanical deformation. As a result, a resistor, which is manufactured by forming stainless steel sheet to an objective shape, produces big noise due to generation of a magnetic field. Resistivity of stainless steel SUS304 could be made higher by increase of Si and Al contents. But, increase of Si and Al makes steel sheet harder and inferior of bending formability, and also intensifies occurrence of ferromagnetic state.

SUMMARY OF THE INVENTION

An object of the present invention is to provide electric resistance material, which is high of resistivity with less temperature dependency and hardly produces noise caused by a magnetic field during flow of electricity, by adoption of alloying design suitable for increase of resistivity and decrease of permeability.

The present invention proposes new electric resistance material, which has the composition consisting of C up to 0.1 mass %, Si up to 5 mass %, Mn up to 6 mass %, 9–32 mass % Cr, 6–25 mass % Ni, N up to 0.2 mass %, 0–3 mass % Mo, 0–4 mass % Cu, 0–5 mass % Al and the balance being Fe except inevitable impurities with the provision that a value A defined by the formula (1) and a value B defined by the formula (2) are adjusted not less than 78 and 14, respectively.

$$A = 0.008\times(\%\ Cr)^3 - 0.43\times(\%\ Cr)^2 + 8.03\times(\%\ Cr) + 6.8\times(\%\ Si) + 10.9\times(\%\ Al) + 0.56\times(\%\ Mo) + 0.92\times(\%\ Ni) \quad (1)$$

$$B = (\%\ Ni) + (\%\ Cu) + 0.6\times(\%\ Mn) + 9.69\times(\%\ C + \%\ N) + 0.18\times(\%\ Cr) - 0.11\times(\%\ Si)^2 \quad (2)$$

The proposed electric resistance material may further contains one or more of Ti up to 0.4 mass %, Nb up to 0.4 mass % and B up to 0.005 mass %.

DETAILED DESCRIPTION OF THE PREFERRED EMBODIMENTS

The inventors have examined various kinds of electric resistance material with respect to resistivity and its temperature dependency, and searched for electric resistance material which is good of hot-workability and bending formability and also hardly produces noise on use. Less temperature dependency of resistivity is necessary for a power or vehicle resistor, which is often heated up to 400° C. or so during flow of electricity. Concretely, an average temperature coefficient of resistivity shall be controlled at a value not more than 1.0007/° C. in a range of 20–400° C.

Figure 1:
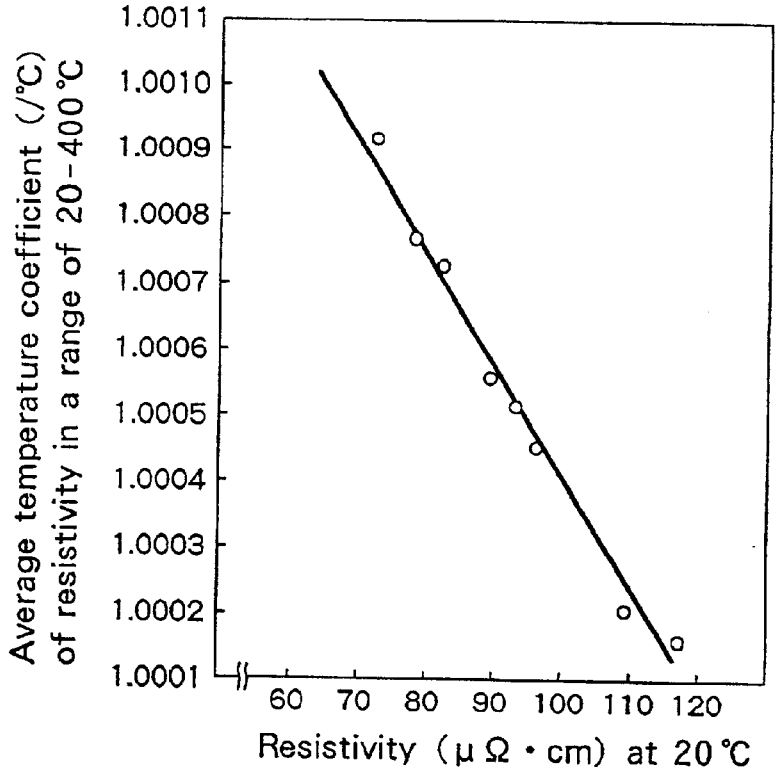
FIG. 1 is a graph illustrating relationship of resistivity at a room temperature with an average temperature coefficient of resistivity in a range of 20–400° C.

From the inventors' researches on relationship of resistivity with an average temperature coefficient in a range of 20–400° C., it is discovered that resistivity not less than 85 $\mu\Omega\cdot$cm is necessary for controlling the average temperature coefficient not more than 1.0007/° C., as shown in FIG. 1. On the other hand, electric resistance material shall be non-magnetic in order to inhibit production of noise caused by generation of a magnetic field.

Accounting these requisitions, the inventors have researched effects of composition of an Fe—Cr—Ni alloy on resistivity in detail, and discovered that resistivity R can be represented by the following formula:

$$R=0.008\times(\%Cr)^3-0.43\times(\%Cr)^2+0.83\times(\%Cr)+6.8\times(\%Si)+10.9\times(\%Al)+1.0\times(\%Mo)+0.92\times(\%Ni)+7.4$$

The relationship means that resistivity R is adjusted to a level not less than 85 $\mu\Omega\cdot$cm by controlling the value A defined by the formula (1) at 78 or more.

Figure 2:
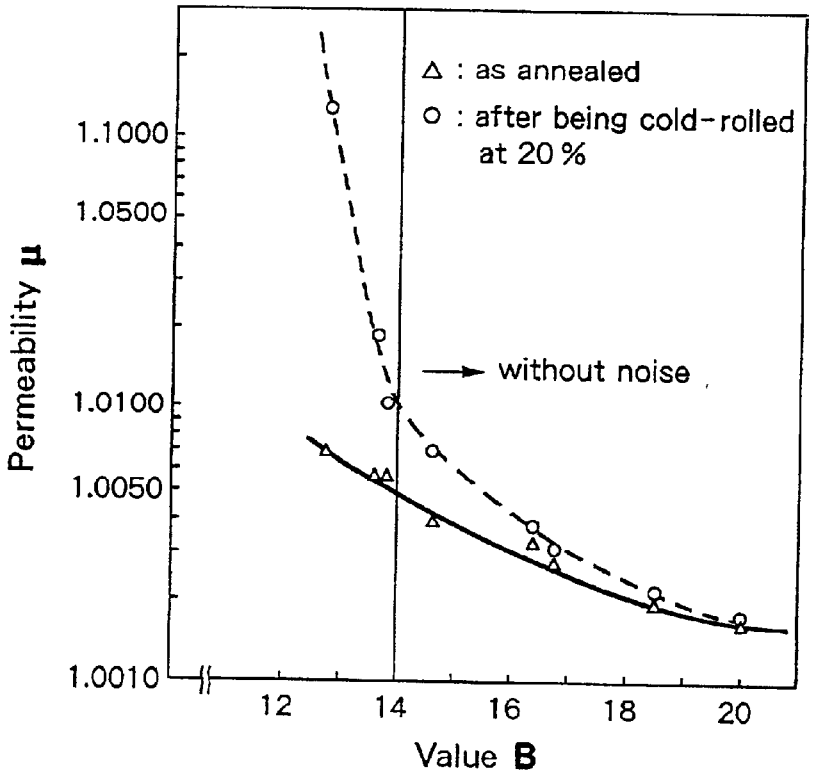
FIG. 2 is a graph illustrating an effect of a value B on permeability $\mu$.

Non-magnetism is evaluated by permeability $\mu$ in general. A resistor is usually manufactured by folding a sheet of electric resistance material to a zigzag shape, since it is necessarily received in a narrow space. If electric resistance material keeps permeability not more than 1.010 even in a zigzag-folded state, production of noise is inhibited. A degree of strain generated by zigzag-folding corresponds to a cold-rolling ratio of 20% at most. In this sense, the inventors have researched relationship of alloying composition with permeability $\mu$ on as-annealed samples and samples cold-rolled at 20%, and discovered that permeability $\mu$ is forecast by a value B defined by the formula (2), as shown in FIG. 2. The relationship of permeability $\mu$ with the value B proves that permeability $\mu$ is kept not more than 1.010 even in state cold-rolled at 20% by controlling the value B at a level not less than 14. Such low permeability $\mu$ means that electric resistance material is still non-magnetic even after being zigzag-folded.

Composition of the newly proposed Fe—Cr—Ni alloy is designed so as to satisfy A≧78 and B≧14 for use as electric resistance material. An effect of each components of the alloy will become apparent by the following explanation.

C is an element effective for non-magnetism, but excessive addition of C more than 0.1 mass % makes the alloy harder and inferior of bending formability.

Si is an element for increase of resistivity, but excessive addition of Si more than 5 mass % makes the alloy harder and inferior of bending formability.

Mn is an alloying element for maintenance of non-magnetic state, but excessive addition of Mn more than 6 mass % causes damage of refractory during refining.

Cr is an alloying element for increase of resistivity and for corrosion and high-temperature oxidation resistance. These effects are typically noted at a ratio of 9 mass % or more. However, excessive addition of Cr more than 32 mass % causes occurrence of scratches on a surface of an alloy sheet during hot-rolling and also worsens toughness and workability of the alloy sheet. An upper limit of Cr content is preferably determined at 20 mass %.

Ni is an alloying element for maintenance of non-magnetic state and increase of resistivity. The Fe—Cr—Ni alloy is not so hardened by increase of Ni content. At least 6 mass % of Ni is necessary for assurance of workability, but excessive addition of Ni more than 25 mass % causes increase of deformation resistance at an elevated temperature and occurrence of cracks, which are originated in grain boundaries on a surface of an alloy sheet in a hot-rolling step. An upper limit of Ni content is preferably determined at 15 mass %.

N is an element effective for maintenance of non-magnetic state, but excessive addition of N more than 0.2 mass % solution-hardens the Fe—Cr—Ni alloy. N content may be adjusted to a normal level (i.e. less than 0.03 mass at which N is included in the alloy in a conventional refining process, without intentional addition.

Mo is an optional element for increase of resistivity, but excessive addition of Mo more than 3 mass % solution-hardens the Fe—Cr—Ni alloy, resulting in poor workability.

Cu is an optional element for maintenance of non-magnetic state with less solution-hardening. However, excessive addition of Cu more than 4 mass % worsens high-temperature ductility and causes occurrence of ear cracks during hot-rolling.

Al is an optional element most effective for increase of resistivity, but excessive addition of Al more than 5 mass % accelerates generation of Al—N intermetallic compound in large quantities and worsens high-temperature ductility. An upper limit of Al content is preferably determined at 2 mass %.

Ti is an optional element for improvement of bending formability, but excessive addition of Ti more than 0.4 mass % causes occurrence of scratches on a surface of a slab prepared by a continuous casting process.

Nb is an optional element for improvement of high-temperature strength, but excessive addition of Nb more than 0.4 mass % worsens ductility of the Fe—Cr—Ni alloy.

If a value B representing non-magnetism exceeds 17, cracks originated in grain boundaries are apt to occur on a surface of a hot-rolled sheet. B is an element for suppression of such cracks. However, excessive addition of B more than 0.005 mass % lowers a melting temperature at grain boundaries, resulting in poor hot-workability.

EXAMPLE

Several Fe—Cr—Ni alloys having compositions shown in Table 1 were melted in a high-frequency vacuum furnace (30 kg). An Fe—Cr—Ni alloy sheet of 2 mm in thickness was manufactured from each melt by casting, blooming, hot-rolling, annealing, pickling, cold-rolling, finish-annealing, pickling and then finish cold-rolling.

In a hot-rolling step, the inventors researched cracks on a surface of the alloy sheet and also cracks at edges of the alloy sheet. The inventive alloys Nos. 1–8 were hot-rolled to objective shape without cracks at its surface or edges. The comparative alloys Nos. 11 and 12 were also hot-rolled without cracks, but significant cracks were detected on a surface of a hot-rolled sheet of the comparative alloy No. 13.

TABLE 1

Chemical Compositions Of Fe—Cr—Ni Alloys

| Alloy | Alloying components (mass %) | | | | | | | | | | | | Values | | |
|---|---|---|---|---|---|---|---|---|---|---|---|---|---|---|---|
| No. | C | Si | Mn | Ni | Cr | Cu | Nb | Al | Mo | Ti | N | B | A | B | Note |
| 1 | 0.06 | 4.2 | 4.9 | 13.0 | 19.2 | 0.0 | 0.0 | 0.0 | 0.0 | 0.0 | 0.15 | 0.004 | 92 | 19 | Inventive |
| 2 | 0.06 | 3.3 | 0.8 | 12.8 | 19.0 | 0.0 | 0.2 | 0.0 | 0.0 | 0.0 | 0.03 | 0.000 | 86 | 16 | Examples |
| 3 | 0.06 | 3.2 | 0.6 | 15.0 | 18.5 | 0.0 | 0.0 | 0.7 | 0.0 | 0.0 | 0.03 | 0.000 | 95 | 18 | |
| 4 | 0.04 | 2.5 | 0.8 | 13.1 | 17.3 | 0.0 | 0.0 | 0.1 | 2.5 | 0.0 | 0.03 | 0.000 | 84 | 17 | |
| 5 | 0.06 | 3.0 | 0.4 | 11.9 | 18.3 | 2.0 | 0.0 | 0.0 | 0.8 | 0.0 | 0.01 | 0.003 | 84 | 17 | |
| 6 | 0.09 | 4.0 | 3.0 | 8.0 | 22.0 | 3.0 | 0.0 | 0.0 | 0.0 | 0.0 | 0.03 | 0.000 | 88 | 16 | |
| 7 | 0.04 | 0.6 | 0.8 | 20.0 | 25.0 | 0.0 | 0.0 | 0.6 | 2.5 | 0.0 | 0.03 | 0.003 | 87 | 26 | |
| 8 | 0.04 | 3.0 | 0.4 | 13.0 | 19.5 | 2.0 | 0.0 | 0.0 | 0.8 | 0.2 | 0.04 | 0.003 | 85 | 19 | |
| 11 | 0.06 | 0.6 | 0.8 | 8.1 | 18.3 | 0.0 | 0.0 | 0.0 | 0.0 | 0.0 | 0.04 | 0.000 | 63 | 13 | Comparative |
| 12 | 0.05 | 3.6 | 1.5 | 8.9 | 18.3 | 0.0 | 0.0 | 0.0 | 0.0 | 0.0 | 0.03 | 0.000 | 84 | 12 | Examples |
| 13 | 0.06 | 0.4 | 2.9 | 14.0 | 18.7 | 0.0 | 0.0 | 0.0 | 0.0 | 0.0 | 0.15 | 0.000 | 67 | 21 | |

Test pieces were cut off each Fe—Cr—Ni alloy sheet and subjected to tests for resistivity, temperature dependency of resistivity and permeability $\mu$ as follows:

Resistivity was measured at various temperatures by a test for resistivity-temperature study regulated in JIS C2526. An average temperature coefficient $\alpha_{20\text{-}400}$ in a range of 20–400° C. was calculated from measurement values.

Test pieces cut off each alloy sheet cold-rolled at 20% were used for measuring permeability $\mu$ with a magnetic balance.

Results shown in Table 2 prove that the inventive Fe—Cr—Ni alloys had temperature dependency of resistivity less than 1.0007/° C. Permeability $\mu$ of any inventive alloy in state cold-rolled at 20% was at a value less than 1.010 suitable for suppression of noise.

On the other hand, the comparative alloy sheet No. 11, whose values A and B were both small, exhibited large temperature dependency of resistivity, so that a resistor made therefrom produced loud noise on use. The comparative alloy sheet No. 12 exhibited small temperature dependency of resistivity due to a value A more than 85, but a resistor made therefrom produced loud noise due to a small value B. The comparative alloy sheet No. 13 was non-magnetic due to a value B being 19 suitable for suppression of noise, but exhibited large temperature dependency of resistivity inappropriate for electric resistance material due to a small value A.

TABLE 2

Properties of Each Fe~Cr~Ni alloys

| Ex. No. | Alloy No. | Resistivity ($\mu\Omega \cdot$ cm) | Temperature dependency (/° C.) of resistivity in a range of 20~400° C. | Permeability $\mu$ as rolled at 20% | Note |
|---|---|---|---|---|---|
| 1 | 1 | 99 | 1.00024 | 1.002 | Inventive |
| 2 | 2 | 93 | 1.00051 | 1.003 | Examples |
| 3 | 3 | 100 | 1.00021 | 1.002 | |
| 4 | 4 | 91 | 1.00055 | 1.003 | |
| 5 | 5 | 90 | 1.00056 | 1.003 | |
| 6 | 6 | 95 | 1.00048 | 1.003 | |
| 7 | 7 | 94 | 1.00051 | 1.001 | |
| 8 | 8 | 92 | 1.00039 | 1.002 | |
| 9 | 11 | 71 | 1.00092 | 1.126 | Comparative |
| 10 | 12 | 92 | 1.00054 | 1.562 | Examples |
| 11 | 13 | 74 | 1.00082 | 1.002 | |

The electric resistance material according to the present invention comprises an Fe—Cr—Ni alloy having a composition designed so as to satisfy the value A, which represents effects of each alloying element on resistivity, not less than 78 as well as the value B, which represents effects of each alloying element on non-magnetism, not less than 14. Due to the controlled values A and B, the Fe—Cr—Ni alloy has high resistivity with less temperature dependency, and a resistor made therefrom works well without noise caused by generation of a magnetic field due to electric current. As a result, the electric resistance material is useful as a resistor for a power generator, for a resistance-controlled vehicle or for other purpose in various industrial fields.

What is claimed is:

1. Electric resistance material having a composition consisting of C up to 0.1 mass %, Si up to 5 mass %, Mn up to 6 mass %, 9–32 mass % Cr, 6–25 mass % Ni, N up to 0.2 mass % and the balance being Fe except inevitable impurities with the provision that a value A defined by the formula (1) and a value B defined by the formula (2) are adjusted not less than 78 and 14, respectively.

$$A = 0.008 \times (\%\ \mathrm{Cr})^3 - 0.43 \times (\%\ \mathrm{Cr})^2 + 8.03 \times (\%\ \mathrm{Cr}) + 6.8 \times (\%\ \mathrm{Si}) + 10.9 \times (\%\ \mathrm{Al}) + 0.56 \times (\%\ \mathrm{Mo}) + 0.92 \times (\%\ \mathrm{Ni}) \quad (1)$$

$$B = (\%\ \mathrm{Ni}) + (\%\ \mathrm{Cu}) + 0.6 \times (\%\ \mathrm{Mn}) + 9.69 \times (\%\ \mathrm{C} + \%\ \mathrm{N}) + 0.18 \times (\%\ \mathrm{Cr}) - 0.11 \times (\%\ \mathrm{Si})^2. \quad (2)$$

2. The electric resistance material defined in claim 1, wherein the material further comprises one or more of Mo up to 3 mass %, Cu up to 4 mass %, Al up to 5 mass %, Ti up to 0.4 mass %, Nb up to 0.4 mass % and B up to 0.005 mass %.

* * * * *